United States Patent [19]

Northrup et al.

[11] Patent Number: 4,860,886

[45] Date of Patent: Aug. 29, 1989

[54] PRE-GLUED DISPLAY CARTON WITH INTEGRAL DISPLAY PANEL

[75] Inventors: David Northrup, Waco, Tex.; Jimmy J. Hanko, Lexington, Ky.

[73] Assignee: Gulf States Paper Corporation, Tuscaloosa, Ala.

[21] Appl. No.: 166,009

[22] Filed: Mar. 9, 1988

[51] Int. Cl.[4] ..... B65D 51/00

[52] U.S. Cl. ..... 206/45.29; 206/45.28; 206/634; 229/16 D

[58] Field of Search ..... 206/44, 45.28, 45.29, 206/45.30, 634, 620; 229/16 D, 41 B

[56] References Cited

U.S. PATENT DOCUMENTS

| | | | |
|---|---|---|---|
| 267,271 | 11/1882 | Snow . | |
| 1,499,987 | 7/1924 | Roe | 206/45.29 |
| 1,590,683 | 6/1926 | Helfrich | 206/45.29 |
| 1,909,473 | 5/1933 | Keppler | 206/45.29 |
| 2,252,147 | 8/1941 | Warren . | |
| 2,649,195 | 8/1953 | Rossi et al. | 206/45.29 |
| 2,812,852 | 11/1957 | Samuels | 206/44 C |
| 3,159,273 | 12/1964 | Schecterson et al. | 206/45.28 |
| 3,729,091 | 4/1973 | Davis | 206/45.29 |
| 3,942,711 | 3/1976 | Desmond et al. | 229/41 B |
| 3,989,181 | 11/1976 | Wilcox et al. | 229/41 B |
| 4,179,061 | 12/1979 | Gilbert | 229/41 B |
| 4,201,291 | 5/1960 | Davidson | 229/44 R |
| 4,416,369 | 11/1983 | Burns | 206/45.28 |
| 4,592,464 | 6/1986 | Londagin | 206/45.28 |
| 4,738,365 | 8/1988 | Prater | 206/634 |

FOREIGN PATENT DOCUMENTS

| | | | |
|---|---|---|---|
| 578816 | of 1958 | Italy | 206/45.29 |
| 302402 | 12/1928 | United Kingdom | 206/45.29 |
| 509172 | 7/1939 | United Kingdom | 206/45.28 |
| 736793 | 9/1955 | United Kingdom | 206/45.29 |
| 1161172 | 8/1969 | United Kingdom | 206/45.28 |

*Primary Examiner*—David T. Fidei

*Attorney, Agent, or Firm*—Cushman, Darby & Cushman

[57] ABSTRACT

A display carton formed from a flat blank to include an integral display panel. The display panel is hingeable from an inoperative position below the removable top panel of the carton into an upright display position during which the deflectable corner portions of the display panel deflect around fixed corner portions of the top panel into overlying positions tending to maintain the display panel in the upright position.

12 Claims, 7 Drawing Sheets

PRE-GLUED DISPLAY CARTON WITH INTEGRAL DISPLAY PANEL

BACKGROUND OF THE INVENTION

This invention relates to display cartons and, more particularly, to improvements in the display panel of such cartons.

The type of display carton herein contemplated are display cartons of the erectable type. Typically, such cartons are formed from a blank of carton material cut and scored to provide an array of side by side panels joined along common sides. Each of the panels is defined by four sides including one or two common sides. The blank also provides side flaps having sides common with certain of the panel sides other than the common sides. The blank is folded along common sides and secured in lapped relation in a flattened preform condition so as to form a first pair of side by side panel structures disposed in adjacent coextensive relation with a second pair of side by side panel structures. The blank is erectable from the flattened preform condition into a rectangular tubular condition wherein the panel structures of each pair of side by side panel structures are moved into perpendicular relationship with one another with the side flaps being foldable to form side flap panel structures positioned to enclose a product containing space defined by the pairs of perpendicularly related panel structures. Conventionally, the packaging equipment is operable to handle a supply of blanks in their flattened preform condition. The packaging equipment is operable to erect each successive blank from its flattened preform condition into a rectangular tubular condition with the product containing space being filled prior to the folding of the last set of side flaps. A typical product included within such cartons is a number of packaged candy bars or the like. In this use, the top panel of the erected carton is formed with perforations which enable the top panel to be manually moved into top opening relation enabling the product containing enclosed space provided by the erect blank to be accessed by a user. In this way, the carton is usable as a display carton for the contents. To aid in displaying the contents for individual sale, it is usual to provide a display panel which is disposed in an upright operative position facing in a direction toward the access to the space provided. Presently, there are two existing commercial arrangements for providing the display panel. The first is to provide a separate panel within the erected carton which is removed when access is obtained and then simply inserted into an erect condition. The second arrangement is to utilize the portion of the top panel which is moved to provide access. Usually, the top panel portion is folded to place it in its upright position. It will also be understood that the patented literature contains disclosures of various specialized cartons having various display panel configurations. Examples of prior art of this type are contained in U.S. Pat. No. 267,671, dated November 7, 1882, and 2,252,147, dated August 12, 1941.

A disadvantage of the present commercial arrangements is that the separate display panel arrangement materially adds to the cost and provides difficulties in handling during packaging. When the top panel itself is utilized, cost is minimized. However, the display panel presents a somewhat ragged appearance inherently because it must present two parallel sides which have been separated by tearing from the erected carton.

SUMMARY OF THE INVENTION

An object of the present invention is to provide an erectable carton which achieves the advantages of both commercial arrangements noted above while eliminating the disadvantages thereof. In accordance with the principles of the present invention, this objective is obtained by forming one panel in the array of side by side panels joined along common sides in the blank which has one common side and the remaining three sides smoothly cut, so as to form a display panel structure hinged along the common side of the one panel. The blank is folded along common sides and secured in lapped relation in a flattened preform condition so as to form a first pair of side by side panel structures disposed in adjacent coextensive relation with a second pair of side by side panel structures with the display panel structure disposed between the first and second pairs of side by side panel structures with the common side thereof disposed adjacent a different common side of one panel structure of the pairs constituting a top panel structure. The blank is erectable from the flattened preform condition into a rectangular tubular condition wherein the panel structures of each pair of side by side panel structures are moved into perpendicular relationship with one another with the side flaps being foldable to form side flap panel structures positioned to enclose a product containing space defined by the pairs of perpendicularly related panel structures. The blank has perforations enabling a portion of the top panel structure extending from the different common side of a size sufficient to expose the display panel structure to be manually moved into top opening relation enabling the product containing enclosed space provided by the erected blank to be accessed after the display panel structure is moved along the common side of the one panel as a hinge from an inoperative position into an upright display position.

Preferably, the top panel structure is defined by a single top panel in the array provided by the blank. The single top panel provides the different common side of the top panel structure and has two perpendicular sides extending from the ends of the different common side. The perforations extend along the different common side between the ends thereof and then diagonally to the perpendicular sides and then along the perpendicular sides. The diagonal extent of the perforations leave fixed corner portions of the top panel between the junctions of the ends of the different common side with the perpendicular sides. The common side of the one panel has its ends cut inwardly to an extent greater than the fixed corner portions so as to define deflectable corner portions operable to (1) underlie the fixed corner portions when the display panel structure is in its inoperative position, (2) deflect around the fixed corner portions during the movement of the display panel structure into its upright display position, and (3) overlie the fixed corner portions when the display panel structure is in its upright display position so as to tend to retain the same therein.

Another object of the present invention is the provision of a display carton comprising six flat panel structures of carton material interconnected to define an enclosed product containing space. The panel structures include a top panel structure having a first side and two second sides extending perpendicularly from the ends of the first side. A display panel structure is hinged to one of the remaining five panel structures adjacent the top panel structure for movement from an inoperative position underlying the top panel structure into an upright operative display position. The display panel structure has a hinge defining peripheral side disposed adjacent the first side of the top panel structure with its ends spaced from the ends of the first side and a remaining periphery defined by smooth cuts or folds. The top panel structure has perforations along the first side between the ends thereof to an extent greater than the extent of the hinge defining side and then diagonally to the second sides and then along the second sides for an extent sufficient to define a portion of the top panel structure greater than the display panel structure. The perforations enable the top panel portion to be manually moved into top opening relation enabling the enclosed space to be accessed after the display panel structure is moved from its inoperative position into its upright display position. The diagonal extent of the perforations leave fixed corner portions of the top panel structure between the junctions of the ends of the first side with the second sides. The cut periphery of the display panel structure defines portions extending outwardly from the ends of the hinge defining side which (1) underlie the top panel fixed corner portions when the display panel structure is in its inoperative position, (2) deflect around the fixed corner portions during the movement of the display panel structure into its upright display position, and (3) overlie the fixed corner portions when the display panel structure is in its upright display position so as to tend to retain the same therein.

Still another object of the present invention is the provision of an erectable carton of the type described which is simple in construction, effective in operation and economical to manufacture.

These and other objects of the present invention will become more apparent during the course of the following detailed description and appended claims.

The invention may best be understood with reference to the accompanying drawings wherein illustrative embodiments are shown.

DESCRIPTION OF THE PREFERRED EMBODIMENTS

Figure 1:
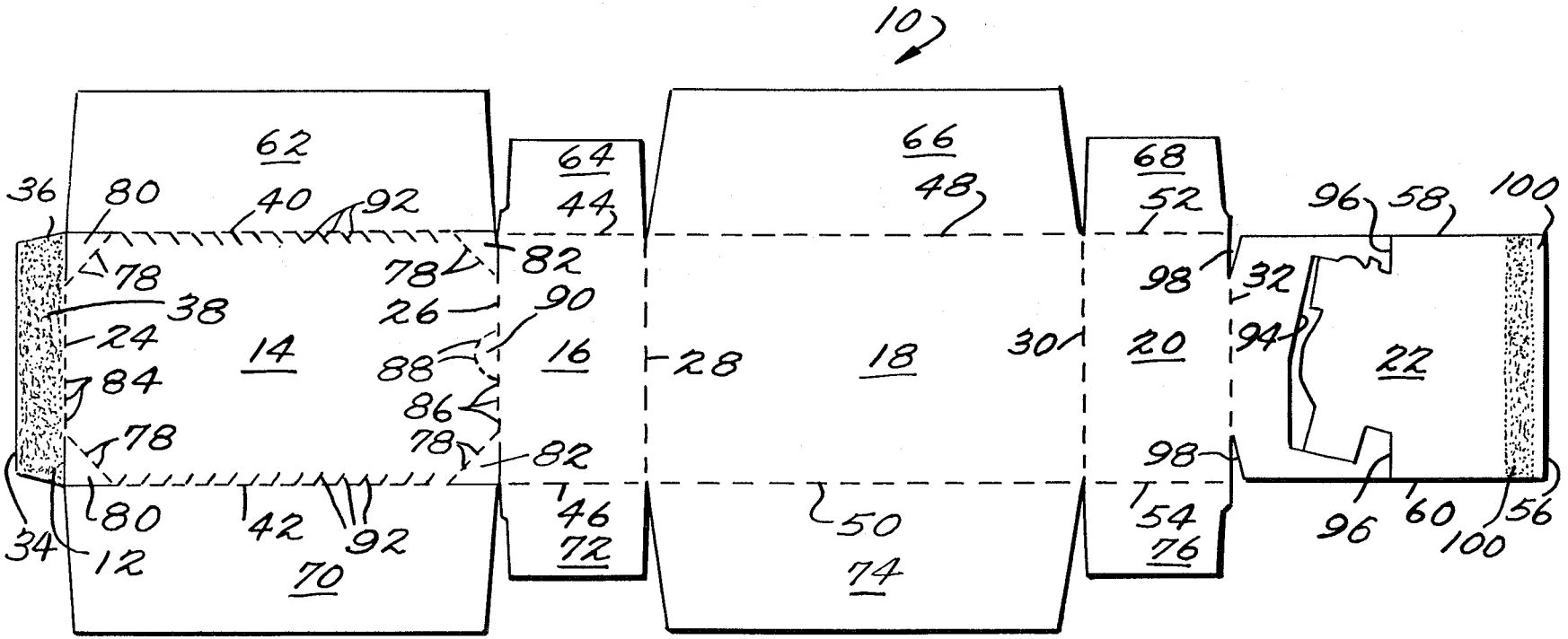
FIG. 1 is an elevational view of one embodiment of a flat blank embodying the principles of the present invention.
Figure 2:
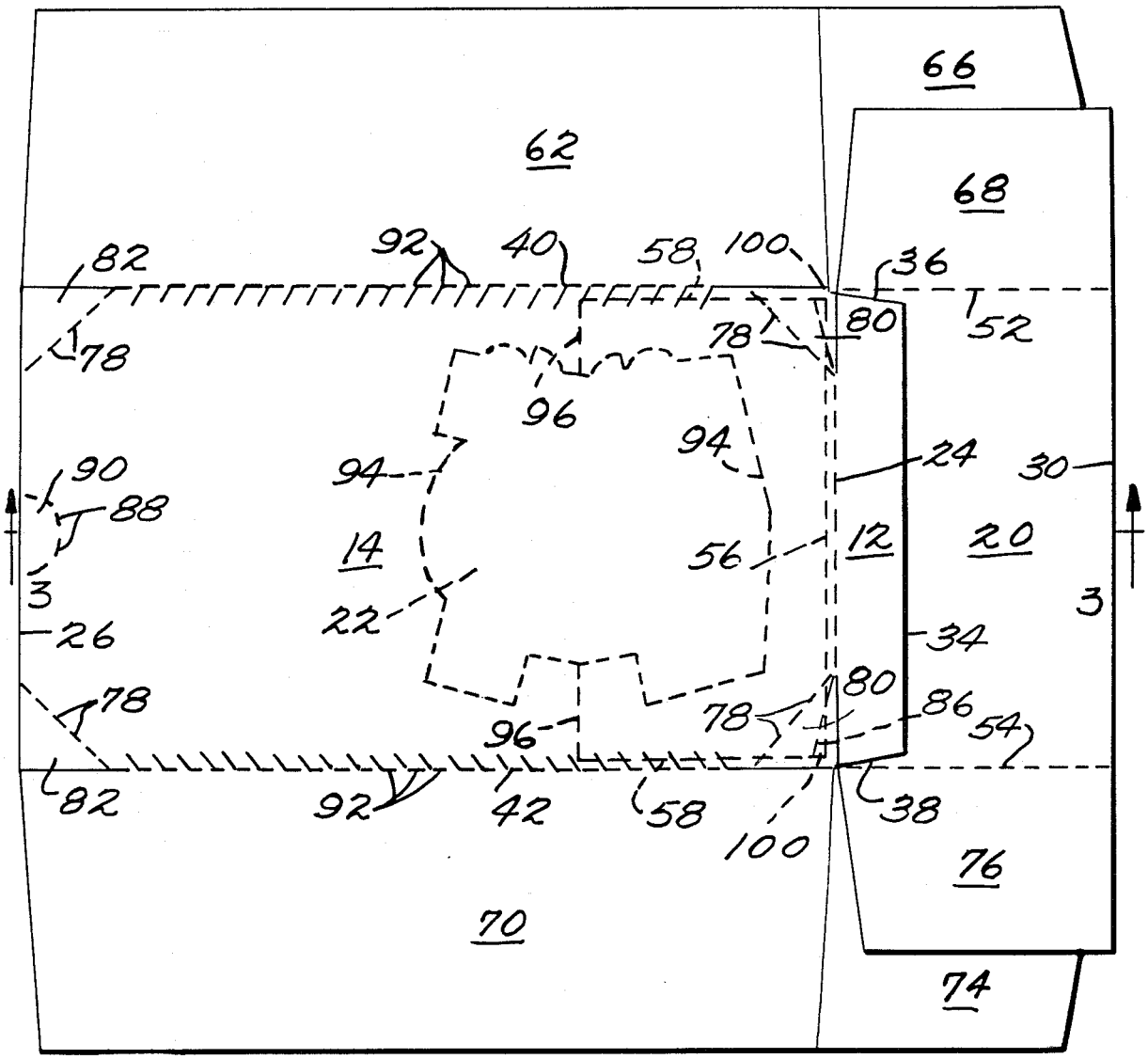
FIG. 2 is an elevational view of the flat blank in its flattened preform condition.
Figure 6:
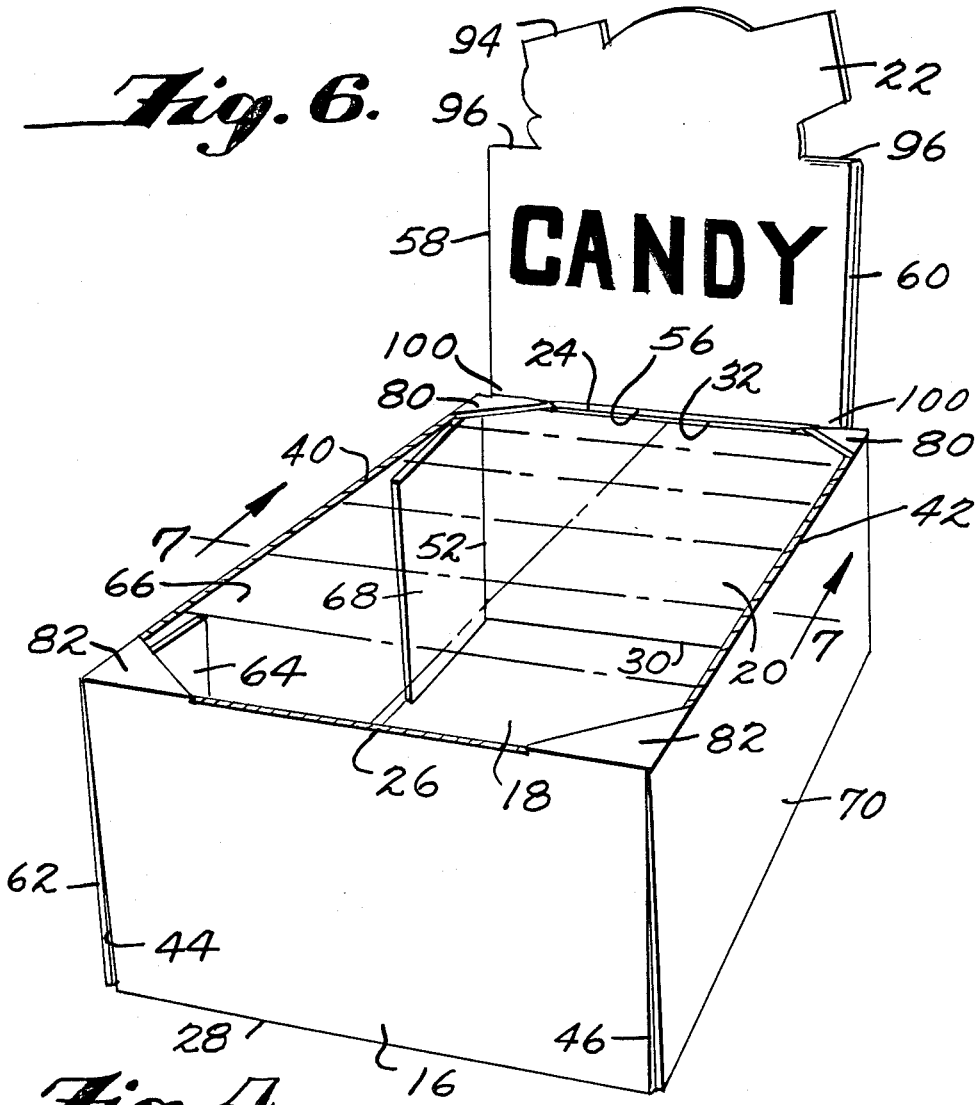
FIG. 6 is a perspective view of the carton showing the display panel structure in its upright display position.

Referring now more particularly to FIG. 1 of the drawings, there is shown therein a flat blank of carton material, such as kraft paperboard or the like, generally indicated at 10, embodying the principles of the present invention. The blank 10 is foldable and securable in lapped relation in a flattened preform condition, such as shown in FIG. 2, and then is erectable into a display carton, as shown in FIG. 6. As shown in FIG. 1, the blank 10 is cut and scored to form an array of side-by-side panels which are designated by numerals 12, 14, 16, 18, 20 and 22. The panels are joined along common sides 24, 26, 28, 30, and 32. Each panel is defined by four sides including one or two of the common sides. As shown, the panel 12 is a partial width first side panel defined by common side 24, a cut parallel side 34, and two cut generally perpendicular sides 36 and 38. Panel 14 is a top panel defined on two sides by the common sides 24 and 26 and by two other perpendicular sides 40 and 42. The panel 16 constitutes a second side panel and is defined by common sides 26 and 28 and by two additional perpendicular sides 44 and 46. The panel 18 constitutes a bottom panel and is defined by common sides 28 and 30 and by two additional perpendicular sides 48 and 50. The panel 20 constitutes a full width first side panel and is defined by common sides 30 and 32 and two additional perpendicular sides 52 and 54. The panel 22 constitutes a display panel and is defined by common side 32, parallel cut side 56 and two additional perpendicular cut sides 58 and 60. The carton material along the non-cut perpendicular sides is cut to form eight side flaps 62, 64, 66, 68, 70, 72, 74, and 76. As shown, each side flap has a common side with one of the panel sides and the remaining periphery thereof cut. As shown, the top panel 14 has sides 40 and 42 common with side flaps 62 and 70, the second side panel 16 has sides 44 and 46 common with side flaps 64 and 72, the bottom panel 18 has sides 48 and 50 common with side flaps 66 and 74 and the full width side panel 20 has sides 52 and 54 common with side flaps 68 and 76.

The nature of the scoring utilized to define the panel sides will be dependent upon the particular carton material utilized in the blank. In the arrangement shown, the sides are formed both by a crease line and slits which serve to facilitate folding. In addition, the top panel 14 is formed with diagonal perforations 78 extending across each corner defining a first pair of fixed corner portions 80 associated with common side 24 and a second pair of fixed corner portions 82 associated with the other common side 26. The diagonal perforations 78 defining fixed corner portions 80 are interconnected along the side 24 by perforations 84. Similarly, the diagonal perforations 78 defining the fixed corner portions 82 are interconnected by perforations 86. An arcuate line of perforations 88 defines with the central extent of the perforations 86 a removable tab 90 for allowing finger engagement by a user. In addition to the above, the diagonal perforations 78 are connected along the sides 40 and 42 by easy tear perforations of known construction indicated at 92.

In addition to the above, the display panel 22 has a central portion thereof cut as indicated at 94. The ends of the cut 94 are centrally located adjacent the sides 58 and 60 respectively and aligned fold lines 96 are formed between the ends of the cut 94 and the adjacent sides 58 and 60. Fold lines 96 and central cut 94 divide the display panel 22 into an inner section associated with common side 32 and an outer section associated with cut side 56. It will also be noted that cuts 98 are formed in the panel 22 extending inwardly from the ends of the side 32 a distance which is slightly greater than the corresponding dimension of the fixed corner portions 80 of the top panel 14.

It will be understood that the blank 10 includes one flat surface which is finished and printed and an opposite surface which is unfinished. As shown by stipling in FIG. 1, the opposite surface of the blank 10 is provided with heat activated glue or the like along the partial width side panel 12 and along the display panel 22 in a strip adjacent the cut side 56. In folding the blank 10 into its flattened preform condition as shown in FIG. 2, the outer section of the display panel 22 is initially folded along the fold lines 96 so as to bring the opposite surface of the outer section of the display panel 22 into opposite surface to opposite surface engagement with the inner section so that the glue on the opposite surface adjacent the side 56 retains the two sections in opposite surface to opposite surface engagement. The display panel 22 in its folded and glued condition constitutes an integral display panel structure which has a hinge connection provided by its common side 32 with side panel 20. Moreover, it will be noted that the display panel structure provides deflectable corner portions 100 along each cut 98 outward of the ends of the hinge connection which act in a manner hereinafter to be more fully described.

Next, the display panel structure and the adjacent side panel 20 are hinged together along the common side 30 of the latter with panel 18 so as to bring the printed surface of the outer section of the display panel 22 into engagement with the opposite surface of the bottom panel 18. Next, the panels 14 and 16 are hinged together about the common side 26 of the latter with the panel 16 so as to bring the glued opposite surfaces of the partial width panel 12 into lapped overlying relation with the printed surface of the side panel 20. The partial width side panel 12 is thus disposed with its common side 24 overlying and adjacent to the common side 32 of the side panel 20, the glue being activated to effect a permanent securement of the two panels 12 and 20 in such opposite surface to printed surface engagement respectively.

Figure 3:
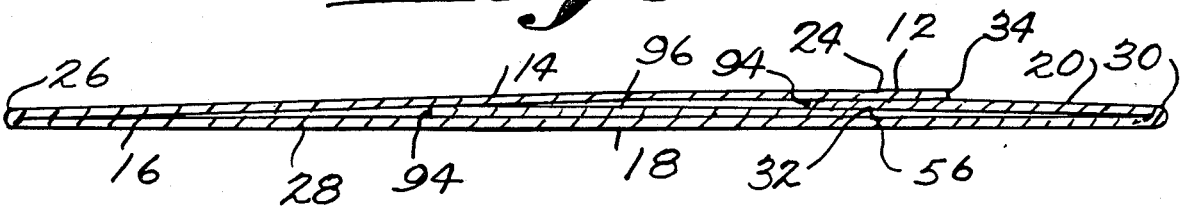
FIG. 3 is a sectional view taken along the line 3—3 of FIG. 2.

The secured together side panels 20 and 12 form a first side panel structure which is disposed in side by side relationship with a second panel structure formed by the top panel 14. Similarly, the side panel 16 and bottom panel 18 form a second pair of side by side panel structures which are coextensive with the first mentioned pair of side by side panel structures. It will be noted that the two pairs of side by side panel structures are in opposite surface facing coextensive relationship with the display panel structure being disposed between the two pairs of side by side panel structures. This flattened preform condition of the blank wherein the blank is folded about certain common sides and secured in lapped relation, as by glue or the like, as previously noted, is illustrated in FIGS. 2 and 3. It will be noted that the position of the display panel structure is such that the common side 23 which forms a hinge connection therefor is disposed adjacent the side 24 which is common to partial side panel 12 and top panel 14.

Figure 4:
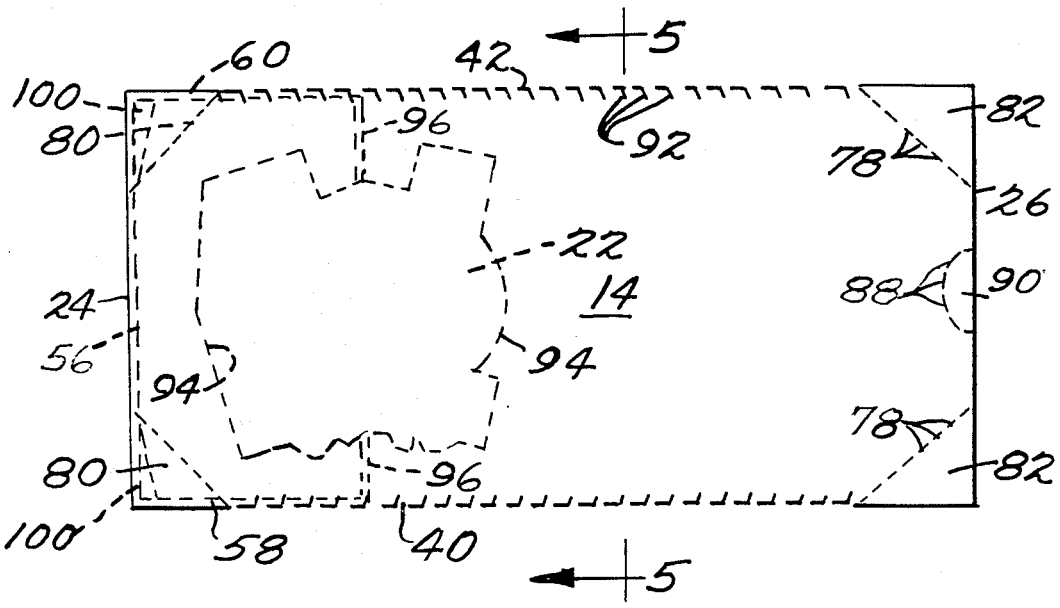
FIG. 4 is a top plan view of the blank in its erected product containing form.
Figure 5:
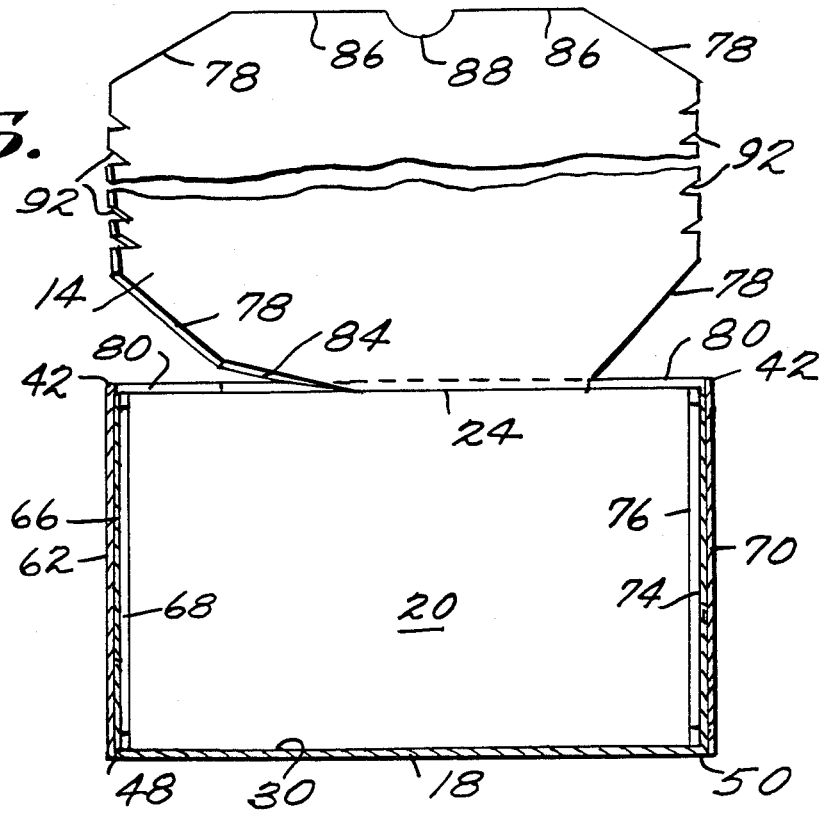
FIG. 5 is a cross-sectional view taken along the line 5—5 showing the top panel partially removed.

The common side 24 defines one side of the first side panel structure and one side of the top panel structure when the blank is erected from its flattened preform condition into a tubular condition. This erecting movement is usually accomplished by packaging machinery capable of feeding successive blanks in flattened preform condition from a supply stack so as to be initially erected in a tubular condition wherein the panel structures of each pair of side by side panel structures are moved from side by side relation into perpendicular relation with respect to one another. The packaging machinery is also operable to fold the side flaps 62, 64, 66, and 68 inwardly into closing relation with the associated sides of the four panel structures disposed in rectangular tubular condition. The side flaps are suitably secured in closing relation by any suitable means such as glue or the like. Similarly, side flaps 70, 72, 74 and 76 are folded into closing relationship after the space within the tubular structure with one end closed is filled with product as for example a gross of candy bars or the like. As before, side flaps 70, 72, 74, and 76 are secured in closing relation by any suitable means such as glue. This complete display carton condition of the blank 10 is shown in FIG. 4 and constitutes the shipping condition of the blank.

Figure 7:
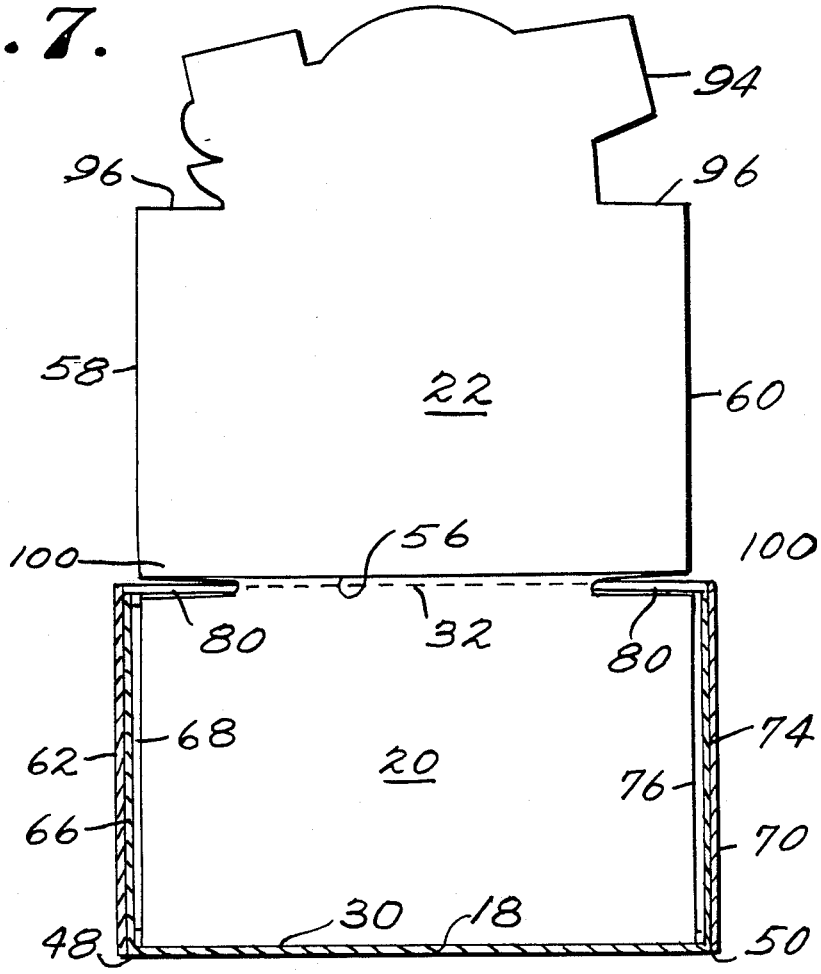
FIG. 7 is a sectional view taken along the line 7—7 of FIG. 6.

In actual use, the operator initially punches the tab 90 out and engages his finger in the hole provided and then separates the adjacent portion of the top panel 14 along the perforations 86 and then along the diagonal perforations 78. Finally by continuing to pull up on the top panel, the entire panel is removed along the side perforations 92, the diagonal perforations 78, and the connecting perforations 84. It will be noted that by removing substantially the entire top panel except for the fixed corner portions 80 and 82 almost total access to the product within the product containing space of the carton is provided. However, it will be noted that the access space is greater than the size of the display panel structure 22 which initially is disposed in an inoperative position beneath the top panel 14. It will be noted that when the display panel structure is in this inoperative position, deflectable corners 100 on the outer section of the display panel 22 are disposed below the adjacent fixed corners 80. The display panel structure must be moved from this inoperative position into an upright operative display position in order to provide full access to the product and to enable the display panel to serve its display function. It will be noted that during the movement of the display panel structure from its inoperative position into its upright operative position, the common side 32 provides a hinge connection and that the deflectable corner portions 100 deflect around the fixed corner portions 80 so that the deflectable portions 100 will be in a position to engage the fixed corner portions when the display panel structure 22 reaches its upright condition thus tending to maintain the same in such position. It will be noted that the printed surface of the outer section of the display panel 22 faces toward the open top of the carton when the display panel structure is in its upright display position as shown in FIGS. 6 and 7. Moreover, it will be seen that the entire periphery of the upright display panel is sharp being defined either by cut edges or folds without the apperance of any torn paperboard.

Figure 8:
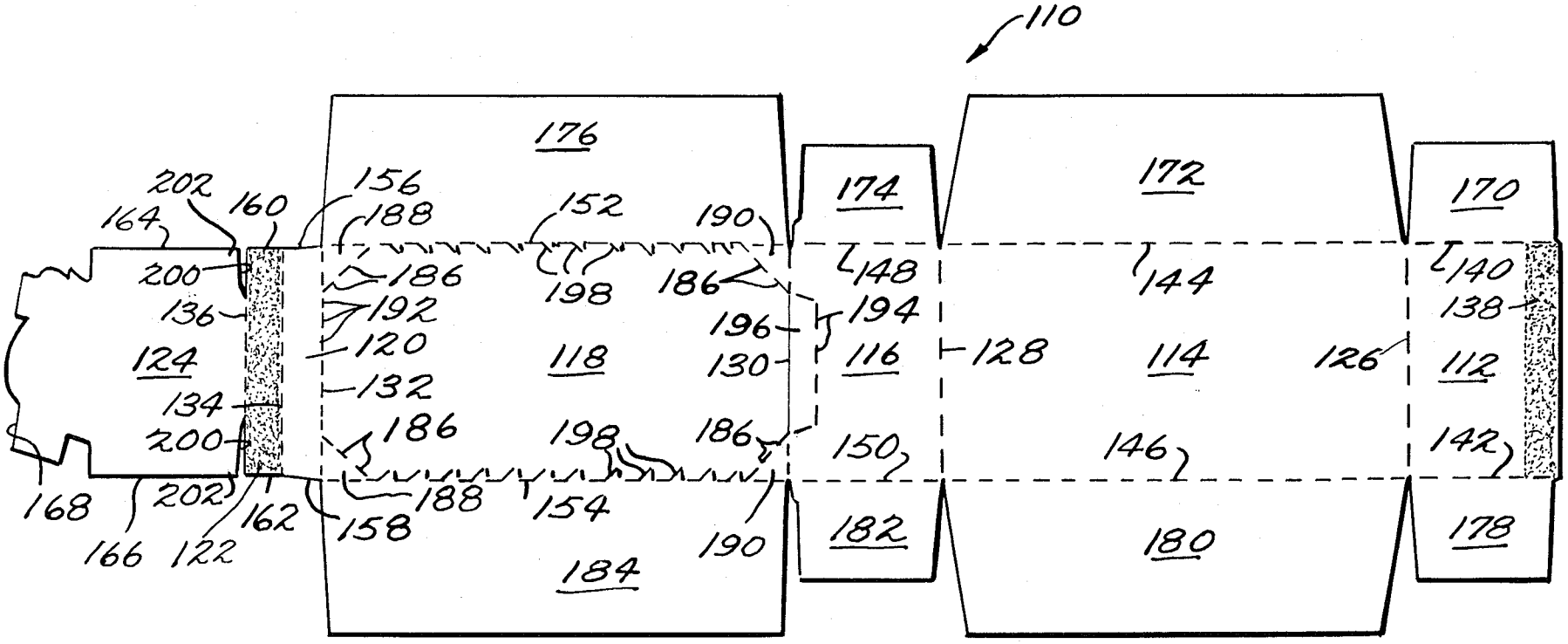
FIG. 8 is a view similar to FIG. 1 of another embodiment of the present invention.
Figure 9:
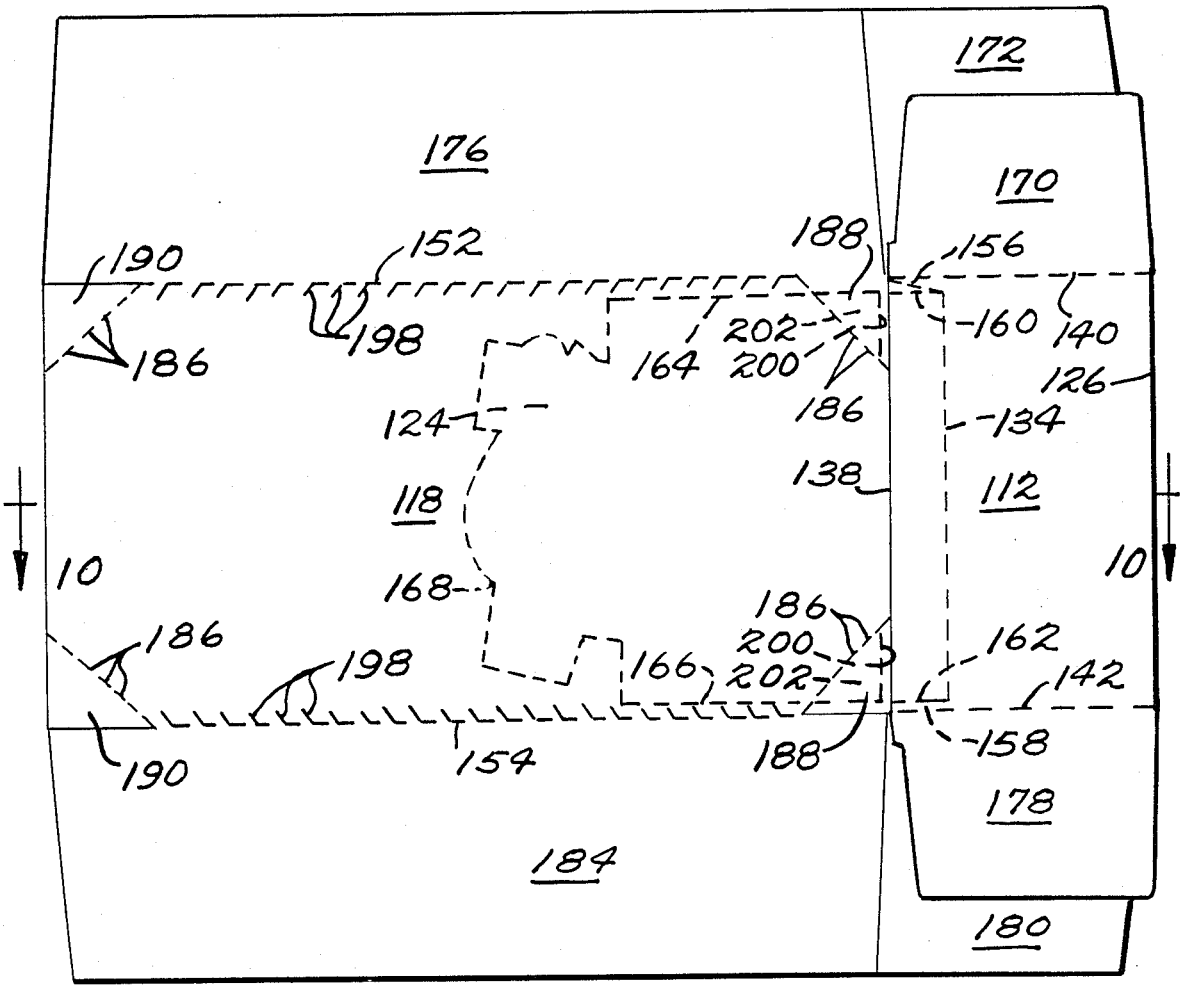
FIG. 9 is a view similar to FIG. 2 of the embodiment shown in FIG. 8.
Figure 11:
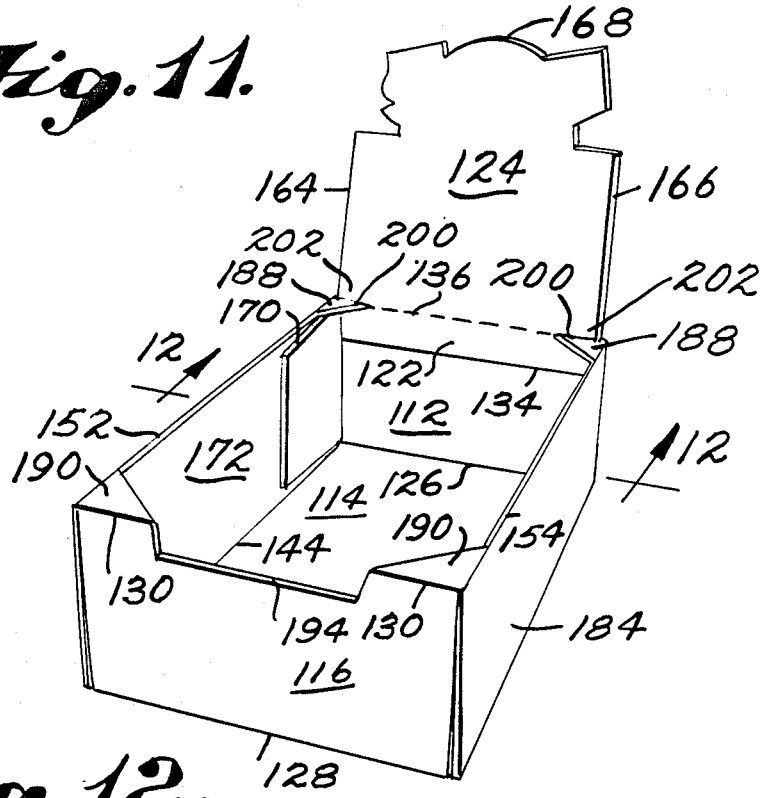
FIG. 11 is a perspective view of the erected carton with the display panel structure in its upright display position.
Figure 12:
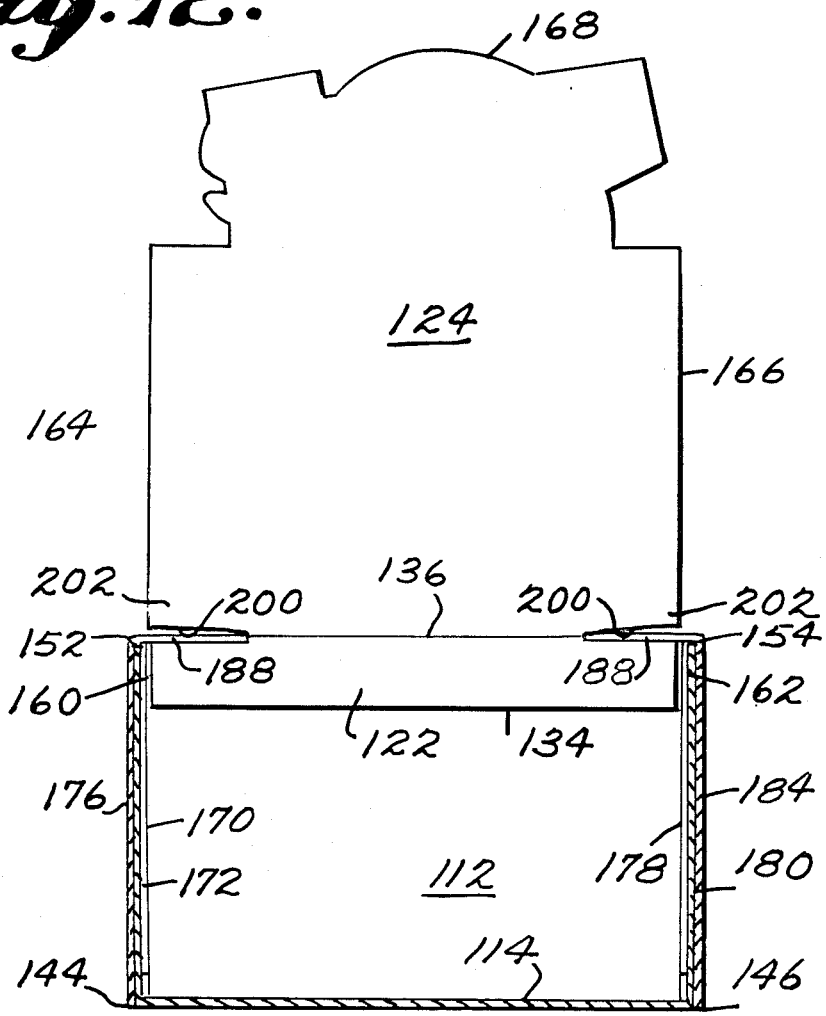
FIG. 12 is a sectional view taken along the line 12—12 of FIG. 11.

Referring now more particularly to FIG. 8 of the drawings, there is shown therein another embodiment of a flat blank of carton material, such as kraft paperboard or the like, generally indicated at 110, embodying the principles of the present invention. The blank 110 is foldable and securable in lapped relation in a flattened preform condition, such as shown in FIG. 9, and then is erectable into a display carton, as shown in FIG. 11. As shown in FIG. 8, the blank 110 is cut and scored to form an array of side-by-side panels which are designated by numerals 112, 114, 116, 118, 120, 122, and 124. The panels are joined along common sides 126, 128, 130, 132, 134, and 136. Each panel is defined by four sides including one or two of the common sides. As shown, the panel 112 is a first side panel defined by common side 126, a cut parallel side 138, and two perpendicular sides 140 and 142. Panel 114 is a bottom panel defined on two sides by the common sides 126 and 128 and by two other perpendicular sides 144 and 146. The panel 116 constitutes a second side panel and is defined by common sides 128 and 130 and by two additional perpendicular sides 148 and 150. The panel 118 constitutes a top panel and is defined by common sides 130 and 132 and by two additional perpendicular sides 152 and 154. The panel 120 constitutes a first narrow side panel and is defined by common sides 132 and 134 and two additional generally perpendicular cut sides 154 and 156. The panel 122 constitutes a second narrow panel similar to panel 120 and is defined by common sides 134 and 136 and two additional generally perpendicular cut sides 160 and 162. The panel 124 constitutes a display panel and is defined by common side 136, a pair of cut perpendicular sides 164 and 166 and an irregular cut side 168. The carton material along the non-cut perpendicular sides is cut to form eight side flaps 170, 172, 174, 176, 178, 180, 182, and 184. As shown, each side flap has a common side with one of the panel sides and the remaining periphery thereof cut. As shown, the side panel 112 has sides 140 and 142 common with side flaps 170 and 178, the bottom panel 114 has sides 144 and 146 common with side flaps 172 and 180, the side panel 116 has sides 148 and 150 common with side flaps 174 and 182 and the top panel 118 has sides 152 and 154 common with side flaps 176 and 184.

The nature of the scoring utilized to define the panel sides will be dependent upon the particular carton material utilized in the blank. In the arrangement shown, the sides are formed both by a crease line and slits which serve to facilitate folding. In addition, the top panel 118 is formed with diagonal perforations 186 extending across each corner defining a first pair of fixed corner portions 188 associated with common side 32 and a second pair of fixed corner portions 190 associated with the other common side 130. The diagonal perforations 186 defining fixed corner portions 188 are interconnected along the side 32 by perforations 192. Similarly, the diagonal perforations 186 defining the fixed corner portions 190 are interconnected by a U-shaped line of perforations 194 formed in the adjacent side panel 116 so as to define a tab 196. It will also be noted that cuts 200 are formed in the panel 124 extending inwardly from the ends of the side 136 a distance which is slightly greater than the corresponding dimension of the fixed corner portions 188 of the top panel 118. Cuts 200 define deflectable corner portions 202 in the display panel 124.

It will be understood that the blank 110 includes one flat surface which is finished and printed and an opposite surface which is unfinished. As shown by stipling in FIG. 8, the opposite surface of the blank 110 is provided with heat activated glue or the like along the narrow side panel 122 (or panel 120 or both) and along the side panel 112 in a strip adjacent the cut side 138. In folding the blank 110 into its flattened preform condition as shown in FIG. 9, the display panel 124 and adjacent narrow panel 122 are initially folded together along the common side 134 between narrow panels 122 and 120 so as to bring the opposite surface of the narrow panel 122 into opposite surface to opposite surface engagement with the narrow panel 120 so that the glue on the opposite surface of narrow panel 122 retains the two narrow panels 122 and 120 in opposite surface to opposite surface engagement. It will also be noted that the opposite surface of the display panel 124 is brought into opposite surface to opposite surface engagement with the top panel 118. The display panel 124 constitutes an integral display panel structure which has a hinge connection provided by its common side 136 with narrow side panel 122.

Next, the four panels 118, 120, 122, and 124, in their folded and glued condition are hinged together along the common side 130 of the latter with panel 18 so as to bring the printed surface of the display panel 124 into engagement with the opposite surface of the bottom panel 114. Next, side panel 112 is hinged about the common side 126 of the latter with the panel 114 so as to bring the glued opposite surfaces thereof into lapped overlying relation with the printed surface of the narrow side panel 122. The side panel 112 is thus disposed with its cut side 138 overlying and adjacent to the common side 132 of the narrow side panel 120, the glue being activated to effect a permanent securement of the two panels 112 and 120 in such opposite surface to printed surface engagement respectively.

Figure 10:
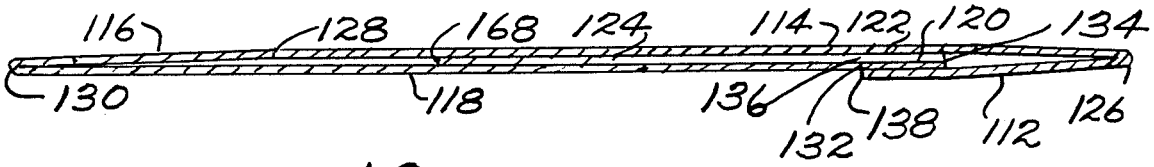
FIG. 10 is a sectional view taken along the line 10—10 of FIG. 9.

The secured together side panels 120, 122, and 112 form a first side panel structure which is disposed in side by side relationship with a second panel structure formed by the top panel 118. Similarly, the side panel 116 and bottom panel 114 form a second pair of side by side panel structures which are coextensive with the first mentioned pair of side by side panel structures. It will be noted that the two pairs of side by side panel structures are in opposite surface facing coextensive relationship with the display panel structure 124 being disposed between the two pairs of side by side panel structures. This flattened preform condition of the blank wherein the blank is folded about certain common sides and secured in lapped relation, as by glue or the like, as previously noted, is illustrated in FIGS. 9 and 10. It will be noted that the position of the display panel structure 124 is such that the common side 136 which forms a hinge connection therefor is disposed adjacent the side 132 which is common to narrow panel 120 and top panel 118.

The common side 132 defines one side of the first side panel structure and one side of the top panel structure when the blank is erected from its flattened preform condition into a tubular condition. This erecting movement is usually accomplished by packaging machinery capable of feeding successive blanks in flattened preform condition from a supply stack so as to be initially erected in a tubular condition wherein the panel structures of each pair of side by side panel structures are moved from side by side relation into perpendicular relation with respect to one another. The packaging machinery is also operable to fold the side flaps 170, 172, 174, and 176 inwardly into closing relation with the associated sides of the four panel structures disposed in rectangular tubular condition. The side flaps are suitably secured in closing relation by any suitable means such as glue or the like. Similarly, side flaps 178, 180, 182, and 184 are folded into closing relationship after the space within the tubular structure with one end closed is filled with product, as, for example, a gross of candy bars or the like. As before, side flaps 178, 180, 182, and 184 are secured in closing relation by any suitable means, such as glue.

In actual use, the operator initially pushes the tab 196 in and engages his fingers in the hole thus formed and then separates the adjacent portion of the top panel 118 along the diagonal perforations 186. Finally by continuing to pull up on the top panel 118, the entire panel is removed along the side perforations 198, the diagonal perforations 186, and the connecting perforations 192. It will be noted that by removing substantially the entire top panel except for the fixed corner portions 188 and 190 almost total access to the product within the product containing space of the carton is provided. However, it will be noted that the access space is greater than the size of the display panel structure 124 which initially is disposed in an inoperative position beneath the top panel 118. It will be noted that when the display panel structure is in this inoperative position, deflectable corners 202 on the outer section of the display panel 124 are disposed below the adjacent fixed corners 188. The display panel structure must be moved from this inoperative position into an upright operative display position in order to provide full access to the product and to enable the display panel to serve its display function. It will be noted that during the movement of the display panel structure 124 from its inoperative position into its upright operative position, the common side 136 provides a hinge connection and that the deflectable corner portions 202 deflect around the fixed corner portions 188 so that the deflectable portions 202 will be in a position to engage the fixed corner portions 188 when the display panel structure 124 reaches its upright condition thus tending to maintain the same in such position. In this display position, it will be noted that the printed surface of the display panel 124 faces toward the open top of the carton and that the entire periphery of the display panel is sharp being defined entirely by cut edges. The embodiment of FIGS. 8–12 has the advantage of a saving in material when compared with the embodiment of FIGS. 1–7.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A display carton comprising six flat panel structures of carton material interconnected to define an enclosed product containing space, said panel structures including a top panel structure having a first side and two second sides extending perpendicularly from opposite ends of said first side, a display panel structure hinged to one of the remaining five panel structures adjacent said top panel structure for movement from an inoperative position underlying said top panel structure into an upright operative display position, said display panel structure having a hinge defining peripheral side disposed adjacent the first side of said top panel structure and having opposite ends spaced from the opposite ends of said first side and a remaining periphery defined by smooth cuts or folds, said top panel structure having perforations along said first side between the opposite ends thereof to an extent greater than the extent of said hinge defining side and then diagonally to said second sides and then along the second sides for an extent sufficient to define a portion of said top panel structure greater than said display panel structure, said perforations enabling said top panel portion to be manually moved into top opening relation with respect to said enclosed space enabling the enclosed space to be accessed after said display panel structure is moved from said inoperative position into said upright display position, the diagonal extent of said perforations leaving fixed corner portions of said top panel structure between the junctions of the opposite ends of said first side with said second sides, the cut periphery of said display panel structure defining deflectable portions extending outwardly from the opposite ends of said hinge defining side which (1) underlie said fixed corner portions when said display panel structure is in said inoperative position, (2) deflect around said fixed corner portions during the movement of said display panel structure into said upright display position, and (3) overlie said fixed corner portions when said display panel structure is in said upright display position so as to tend to retain the same therein.

2. A display carton as defined in claim 1 wherein said display panel structure includes a fourth side parallel with said first side, said perforations extending diagonally from said second side to positions spaced from opposite ends of said fourth side so as to define two further fixed corner portions, said perforations extending between said positions spaced from the opposite ends of said fourth side so as to enable the entire top panel structure except for said four fixed corner portions to be removed so as to establish said top opening relation.

3. An erectable carton comprising a flat blank of carton material cut and scored to provide an array of side by side panels including outer panels at the outer ends of the array and inner panels therebetween, each of said inner panels being joined in the array along opposite common sides and having two other sides, each of said outer panels being joined in the array along a single common side and having three other sides, said flat blanks also including side flaps having sides joined with certain of said other sides of said panels, one of said outer panels having said three other sides thereof defined by smooth cuts so as to provide a display panel structure hinged along said single common side of said one outer panel, said blank being folded along said common sides and secured in lapped relation in a flattened preform condition so as to form a first pair of side by side panel structures disposed in adjacent coextensive relation with a second pair of side by side panel structures with said display panel structure disposed between said first and second pairs of side by side panel structures, one inner panel forming said first and second pairs of panel structures constituting a top panel and having one of the opposite common sides thereof disposed adjacent said single common side of said display panel structure, the inner panels of said array including first and second similarly shaped narrow panels having one of their opposite common sides joined together, said first narrow panel having the other of the opposite common sides thereof joined with said single common side of said display panel structure, said second narrow panel having the other of the opposite sides thereof joined with said one common side of said top panel, said first and second narrow panels being folded along the joined common sides thereof into opposite surface to surface engagement and secured therein, said blank being erectable from said flattened preform condition into a rectangular tubular condition wherein the panel structures of each pair of side by side panel structures are moved into perpendicular relationship with one another with the side flaps being foldable to form side flap panel structures positioned to enclose a product containing space defined by said each pair of perpendicularly related panel structures, said blank having perforations enabling a portion of said top panel extending from said one common side thereof of a size sufficient to expose said display panel structure to be manually moved into top opening relation with respect to said product containing enclosed space enabling said space to be accessed after said display panel structure is moved along said single common side thereof from an inoperative position into an upright display position.

4. An erectable carton as defined in claim 3 wherein said blank when in said flat condition includes a printed surface and an opposite surface, said first and second pairs of side by side panel structures and said side flaps being formed by panels presenting the printed surfaces thereof in a position to define the exterior of the erected flattened preform, said one outer panel providing the display panel structure with a printed surface facing in a direction toward the access to the space provided when said display panel structure is moved into said upright display position.

5. An erectable carton as defined in claim 4 wherein said three other sides of said one outer panel include two straight parallel other sides perpendicular to said single common side thereof and a third other side extending between said two straight parallel other sides, said third other side being spaced above said single common side of said display panel structure when in said upright position.

6. An erectable carton as defined in claim 5 wherein said perforations extend along said one common side of said top panel between ends thereof and then diagonally to said two other sides thereof and then along said two other sides thereof, the diagonal extent of said perforations leaving two fixed corner portions of said top panel between the junctions of the ends of said one common side with said two other sides of said top panel, said single common side of said one outer panel having ends cut inwardly to an extent greater than said fixed corner portions so as to define deflectable corner portions operable to (1) underlie said fixed corner portions when said display panel structure is in said inoperative position, (2) deflect around said fixed corner portions during the movement of said display panel structure into said upright display position, and (3) overlie said fixed corner portions when said display panel structure is in said upright display position so as to tend to retain the same therein.

7. An erectable carton as defined in claim 6 wherein said perforations extend diagonally from said two other sides of said top panel to positions spaced on a second of the opposite common sides of said top panel so as to define two further fixed corner portions, said perforations further extending between said spaced positions so as to enable the entire top panel except for said four fixed corner portions to be removed so as to establish said top opening relation.

8. An erectable carton comprising a flat blank of carton material cut and scored to provide an array of six side by side panels including two outer panels at the outer ends of the array and four inner panels therebetween, each of said inner panels being joined in the array along opposite common sides and having two other sides, each of said outer panels being joined in the array along a single common side and having three other sides, said flat blank also including side flaps having sides joined with certain of said other sides of said panels, one of said outer panels having said three other sides thereof defined by smooth cuts so as to provide a display panel structure hinged along said single common side of said one outer panel, said blank being folded along said common sides and secured in lapped relation in a flattened preform condition so as to form a first pair of side by side panel structures disposed in adjacent coextensive relation with a second pair of side by side panel structures with said display panel structure disposed between said first and second pairs of side by side panel structures, one inner panel forming said first and second pairs of panel structures constituting a top panel and having one of the opposite common sides thereof disposed adjacent said single common side of said display panel structure, said blank being erectable from said flattened preform condition into a rectangular tubular condition wherein the panel structures of each pair of side by side panel structures are moved into perpendicular relationship with one another with the side flaps being foldable to form side flap panel structures positioned to enclose a product containing space defined by said each pair of perpendicularly related panel structures, said blank having perforations enabling a portion of said top panel extending from said one common side thereof of a size sufficient to expose said display panel structure to be manually moved into top opening relation with respect to said product containing enclosed space enabling said space to be accessed after said display panel structure is moved along said single common side thereof from an inoperative position into an upright display position.

9. An erectable carton as defined in claim 8 wherein said blank when in said flat condition includes a printed surface and an opposite surface, said first and second pairs of side by side panel structures and said side flaps being formed by panels presenting the printed surfaces thereof in a position to define the exterior of the erected flattened preform, said one outer panel providing the display panel structure with a printed surface facing in a direction toward the access to the space provided when said display panel structure is moved into said upright display position.

10. An erectable carton as defined in claim 9 wherein said three other sides of said one outer panel include two straight parallel other sides perpendicular to said single common side thereof and a third other side extending between said two straight parallel other sides, said one outer panel including a central portion having a cut therein spaced from said two straight parallel other sides and spaced aligned fold lines between said central portion cut and said two straight parallel other sides, said fold lines and said central portion cut dividing said one outer panel into two sections, said one outer panel being folded along said fold lines in a direction to bring the opposite surfaces of the sections of said one outer panel into engagement, and means for securing the sections of said one outer panel in said opposite surface to opposite surface engagement such that said third other side of said one outer panel is disposed adjacent the single common side thereof.

11. An erectable carton as defined in claim 10 wherein said perforations extend along said one common side of said top panel between ends thereof and then diagonally to said two other sides thereof and then along said two other sides thereof, the diagonal extent of said perforations leaving two fixed corner portions of said top panel between the junctions of the ends of said one common side with said two other sides of said top panel, said single common side of said one outer panel having ends cut inwardly to an extent greater than said fixed corner portions so as to define deflectable corner portions operable to (1) underlie said fixed corner portions when said display panel structure is in said inoperative position, (2) deflect around said fixed corner portions during the movement of said display panel structure into said upright display position, and (3) overlie said fixed corner portions when said display panel structure is in said upright display position so as to tend to retain the same therein.

12. An erectable carton as defined in claim 11 wherein said perforations extend diagonally from said two other sides of said top panel to positions spaced on a second of the opposite common sides of said top panel so as to define two further fixed corner portions, said perforations further extending between said spaced positions so as to enable the entire top panel except for said four fixed corner portions to be removed so as to establish said top opening relation.

* * * * *